US009655417B1

(12) United States Patent
Browne

(10) Patent No.: US 9,655,417 B1
(45) Date of Patent: May 23, 2017

(54) SUNSHADE UMBRELLA

(71) Applicant: Bill Browne, Atlanta, GA (US)

(72) Inventor: Bill Browne, Atlanta, GA (US)

(73) Assignee: Atleisure LLC, Atlanta, GA (US)

( * ) Notice: Subject to any disclaimer, the term of this patent is extended or adjusted under 35 U.S.C. 154(b) by 0 days.

(21) Appl. No.: 14/971,101

(22) Filed: Dec. 16, 2015

(51) Int. Cl.
*A45B 25/14* (2006.01)
*E04H 15/28* (2006.01)
*A45B 25/18* (2006.01)

(52) U.S. Cl.
CPC ..... *A45B 25/14* (2013.01); *A45B 25/18* (2013.01); *E04H 15/28* (2013.01); *A45B 2025/146* (2013.01)

(58) Field of Classification Search
CPC ..... E04H 15/28; E04H 15/04; E04H 15/48; E04H 15/58; A45B 25/02; A45B 2023/0037; A45B 25/10; A45B 25/14; A45B 25/16; A45B 25/18; A45B 25/22; A45B 2025/146
USPC ..... 135/90, 98, 20.3, 21, 28, 48, 16, 33.4; 211/197
See application file for complete search history.

(56) References Cited

U.S. PATENT DOCUMENTS 2,224,882 A * 12/1940 Peck ..... A45B 17/00 135/119
2,685,885 A * 8/1954 West ..... A45B 23/00 135/20.3
4,676,262 A * 6/1987 Yang ..... A45B 25/16 135/25.3
5,174,319 A * 12/1992 Chou ..... A45B 25/143 135/20.3
5,309,932 A * 5/1994 Chou ..... A45B 25/143 135/22
5,564,449 A * 10/1996 Lin ..... A45B 25/16 135/24
5,711,333 A * 1/1998 Vanderminden, Sr. A45B 17/00 135/20.1
7,318,443 B1 * 1/2008 Ma ..... A45B 25/18 135/20.3
2004/0060586 A1 * 4/2004 Ma ..... A45B 25/14 135/20.3
2010/0024856 A1 * 2/2010 Li ..... A45B 17/00 135/20.3
2013/0333735 A1 * 12/2013 Chen ..... A45B 25/02 135/25.4

* cited by examiner

*Primary Examiner* — Winnie Yip
(74) *Attorney, Agent, or Firm* — ATLawip LLC; Jeffrey T. Breloski

(57) ABSTRACT

An umbrella includes a canopy, a stand body, a supporting pole, a rope device for opening and closing the umbrella, and a spring member. The stand body includes a plurality long umbrella ribs, a plurality short umbrella ribs, an upper canopy and a bottom canopy. Each of the long umbrella rib and the short umbrella rib have a first end and a second end. The first end of the long umbrella rib is rotatably connected with the upper canopy and the second end of the long rib is hinged at the second end of the short rib, while the first end of the short rib is rotatably connected with the bottom canopy. The upper canopy is placed in the middle of a vertical pole within the stand body. The bottom canopy is sheathed on the vertical pole and can move up and down. The spring member is placed above the upper canopy.

6 Claims, 5 Drawing Sheets

SUNSHADE UMBRELLA

FIELD OF THE INVENTION

This invention relates generally to an umbrella, and more particularly to a new and improved steeped pagoda sunshade umbrella that can be easily assembled with novel appearance.

BACKGROUND OF THE INVENTION

The background description provided herein is for the purpose of generally presenting the context of the present invention. The subject matter discussed in the background of the invention section should not be assumed to be prior art merely as a result of its mention in the background of the invention section. Similarly, a problem mentioned in the background of the invention section or associated with the subject matter of the background of the invention section should not be assumed to have been previously recognized in the prior art. The subject matter in the background of the invention section merely represents different approaches, which in and of themselves may also be inventions. Work of the presently named inventor, to the extent it is described in the background of the invention section, as well as aspects of the description that may not otherwise qualify as prior art at the time of filing, are neither expressly nor impliedly admitted as prior art against the present invention.

With the rapid development of tourism, patio umbrellas and offset umbrellas, as a kind of outdoor living furniture, are used widely in leisure areas such as square, beach, park and garden to provide comfortable and cool space for people. Such umbrella typically includes an umbrella canopy, a stand, and a pole. To meet customers' requirement of visual diversity of the appearance of patio umbrellas and offset umbrellas, a common way is to decorate the umbrellas by changing colors or patterns of the canopies. However, changing colors or patterns of the canopies do not create novel appearance of shapes of the umbrellas. In recent years, customers pay closer attention to diversifying patios through changing the shapes of the umbrellas. Currently, shapes of umbrellas include octagon, hexagon, cabochon and so on. Nevertheless, umbrellas with canopies of the octagon, hexagon, and cabochon shapes are expensive in construction and structurally complicated for assembly.

As such, a heretofore unaddressed need exists in the art to address the aforementioned inadequacies.

BRIEF SUMMARY OF THE INVENTION

In one aspect, the invention relates to a sunshade umbrella includes an umbrella canopy, an umbrella stand body, and a supporting pole to the umbrella stand body. The umbrella also includes a rope device, which could open and close the umbrella to the supporting pole. The umbrella stand body includes a plurality of long umbrella ribs, a plurality of short umbrella ribs, an upper canopy and a bottom canopy. The umbrella stand body also includes a pulley member, which is placed on the upper canopy. Each of the long umbrella ribs and the short umbrella ribs have a first end and a second end. The first end of the long umbrella rib is rotatably connected with the upper canopy. The second end of the long umbrella rib is hinged at the second end of the short rib. The first end of the short rib is rotatably connected with the bottom canopy. The upper canopy is placed in the middle area of the supporting pole. The bottom canopy is sheathed on the supporting pole and can freely move up and down. Further, the long umbrella ribs and short umbrella ribs are formed of elastic cartilage materials, which can bend under wind pressure and can return to the original state automatically after the wind stops. In addition, the umbrella stand also includes a spring member, which is placed above the upper canopy to support the umbrella canopy, and a fastening member attached to the spring member and drives the spring member to move up and down when the umbrella opens and closes. The umbrella canopy is sleeved with the spring member and the fastening member on the supporting pole, such that, when assembled, the spring member can tightly support the umbrella canopy. The umbrella canopy, the fastening member and the spring member are connected such that the fastening member comprises a hollow buckle that includes a male portion and a female portion, and the hollow buckle connects the umbrella canopy with riveted connection.

In one embodiment, the long umbrella ribs and short umbrella ribs are formed of elastic cartilage materials, which can bend under wind pressure and can return to the original state automatically after the wind stops.

In another embodiment, the long umbrella ribs and short umbrella ribs are hard ribs shaped as long tubes, based on the requirements of the appearance of the umbrella.

In another embodiment, the upper canopy is arranged with the pulley member in the middle area of the supporting pole by a dowel pin.

In another embodiment, the shape of opened umbrella is steeped.

These and other aspects of the present invention will become apparent from the following description of the preferred embodiment taken in conjunction with the following drawings, although variations and modifications therein may be effected without departing from the spirit and scope of the novel concepts of the invention.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment, and wherein.

DETAILED DESCRIPTION OF THE INVENTION

Figure 1:
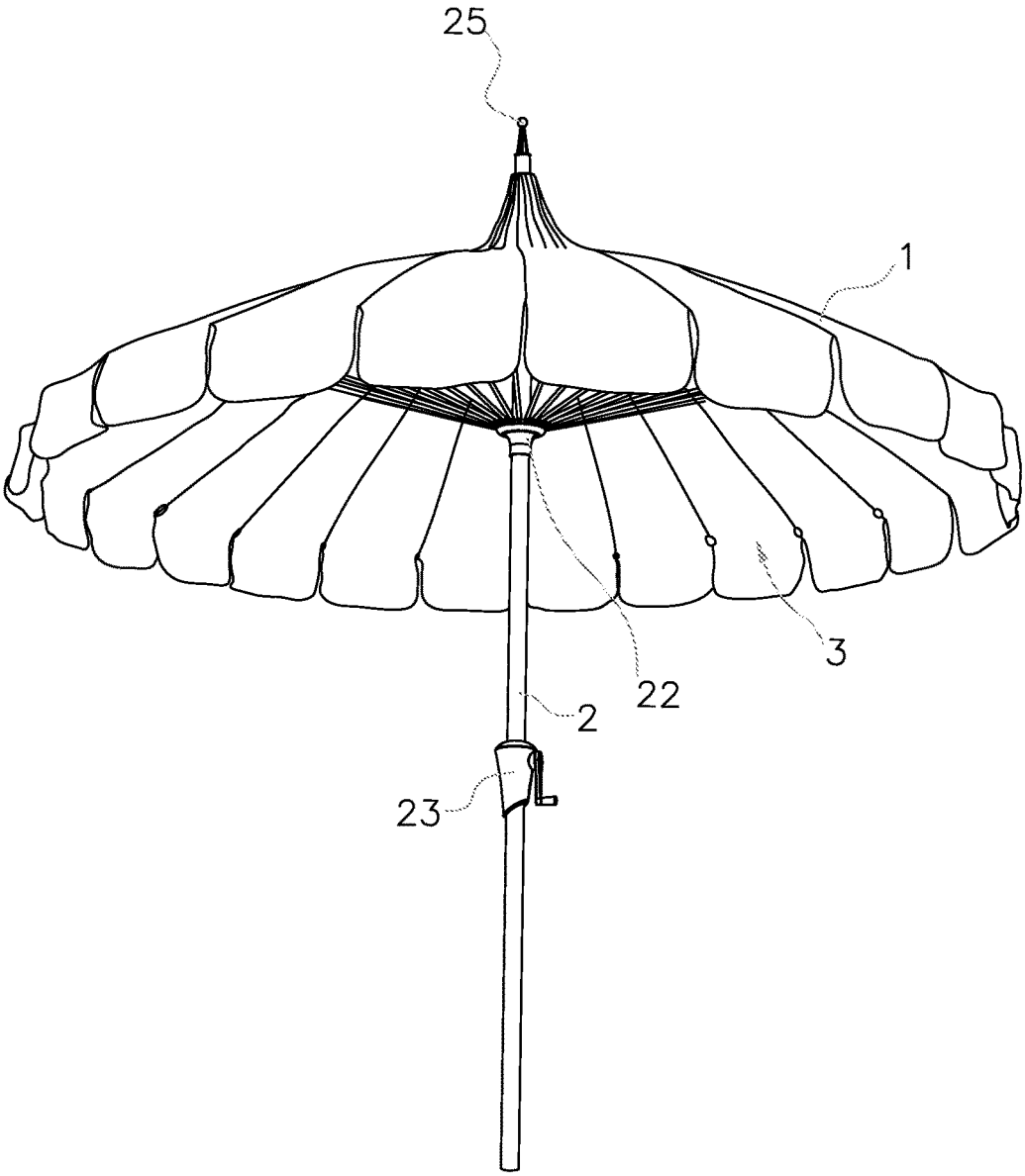
FIG. 1 shows a structural schematic according to one embodiment of the invention.

The present disclosure will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the invention or of any exemplified term. Likewise, the invention is not limited to various embodiments given in this specification.

It will be understood that when an element is referred to as being "on" another element, it can be directly on the other element or intervening elements may be present there between. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom," "upper" or "top," and "left" and "right," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around," "about" or "approximately" shall generally mean within 20 percent, preferably within 10 percent, and more preferably within 5 percent of a given value or range. Numerical quantities given herein are approximate, meaning that the term "around," "about" or "approximately" can be inferred if not expressly stated.

The description will be made as to the embodiments of the present disclosure in conjunction with the accompanying drawings. In accordance with the purposes of this disclosure, as embodied and broadly described herein, this disclosure, in one aspect, relates to an actuator for converting a rotating motion into a linear reciprocating motion and applications of the same.

Figure 2:
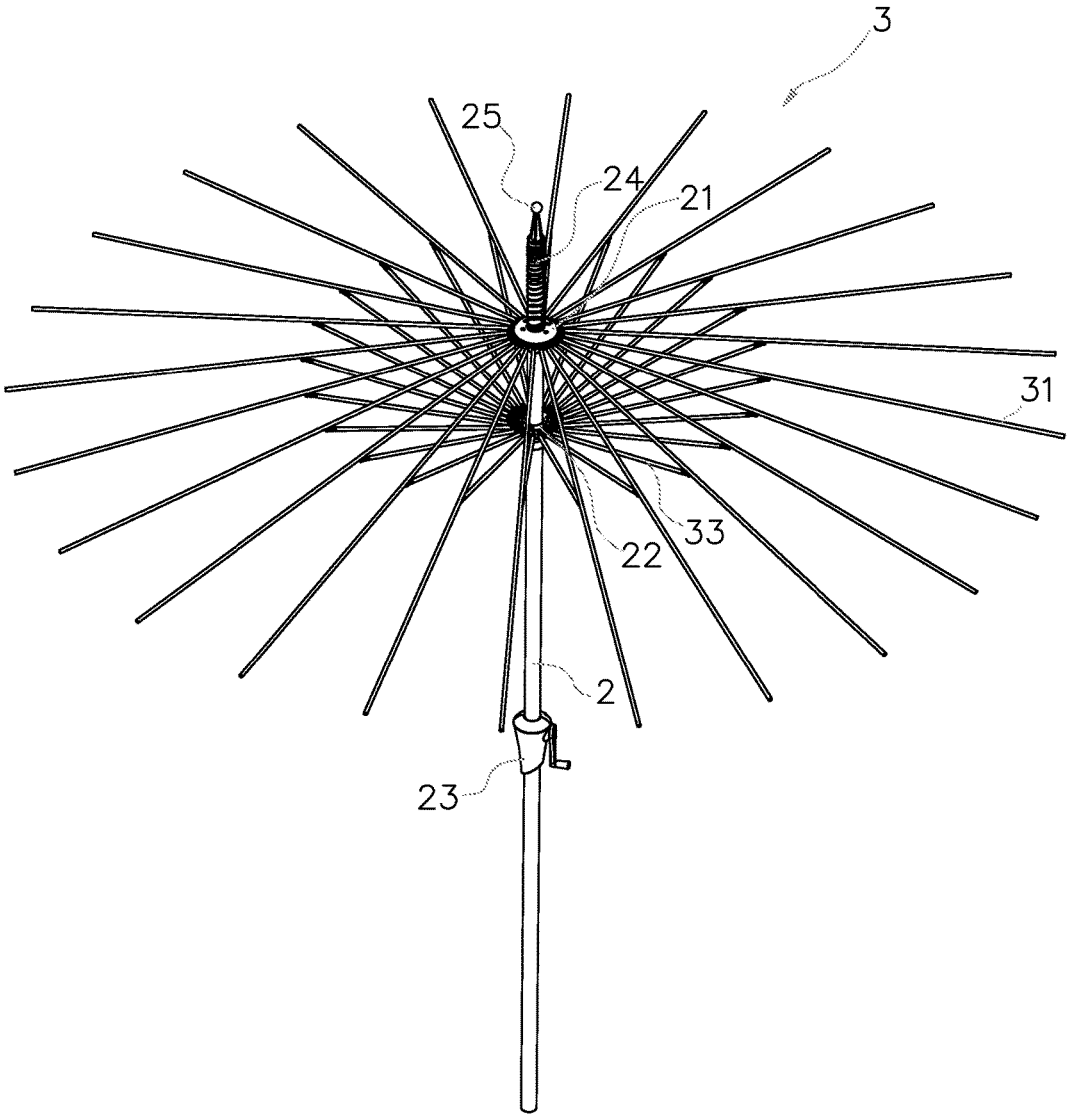
FIG. 2 shows a structural schematic of FIG. 1 without an umbrella canopy.
Figure 3:
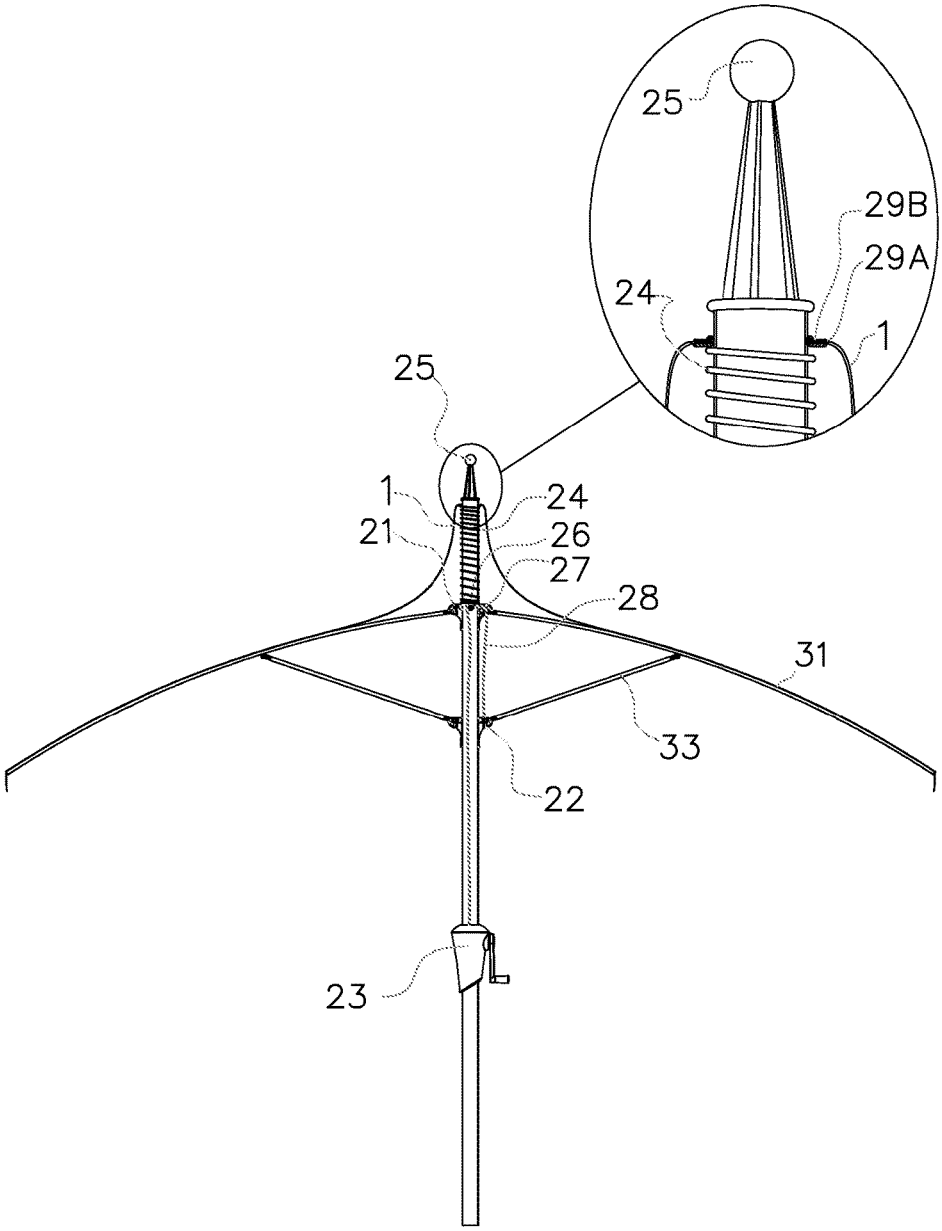
FIG. 3 shows enlarged sectional view of the structure of the embodiment showed in FIG. 1.

Referring to FIGS. 1-2, the new steeped pagoda sunshade umbrella includes the umbrella stand body 3, the supporting pole 2, and the umbrella canopy 1, which is positioned to cover the umbrella stand body 3. The umbrella also includes a rope device 23, which could open and close the umbrella to the supporting pole 2. The umbrella stand body 3 includes a plurality of long umbrella ribs 31, a plurality of short umbrella ribs 33, an upper support element 21 and a runner 22. Each of the long umbrella ribs 31 and the short umbrella ribs 33 has a first end and a second end. The first end of the long umbrella rib 31 is rotatably connected with the upper support element 21. The second end of the long umbrella rib 31 is hinged at the second end of the short umbrella rib 33. The first end of the short umbrella rib 33 is rotatably connected with the runner 22. The upper support element 21 is placed in the middle area of the supporting pole 2, and the runner 22 is located below the upper support element 21. The umbrella stand body 3 also includes a pulley member 27, which is placed on the upper support element 21. As shown in FIG. 3, the upper support element 21 is arranged with the pulley member 27 in the middle area of the supporting pole 2 by a dowel pin 26.

Referring to FIG. 3, above the upper support element 21, an umbrella cap 25 is placed on the top of the supporting pole 2 and the pulley member 27 is arranged inside the upper support element 21 and is attached to the upper support element 21. The runner 22 is sheathed on the supporting pole 2 and can freely move up and down. Relative to the supporting pole 2, the long umbrella ribs 31 and the short umbrella ribs 33 can open or close through the rope device 23 via driving umbrella rope 28, which also drives the runner 22 to move up and down.

A spring member 24, which supports the umbrella canopy 1, is placed above the upper support element 21. A fastening member 29 is attached to the spring member 24 and moves with the spring member 24 up and down when the umbrella opens and closes. The fastening member 29 can be a hollow buckle comprising a male portion 29A and a female portion 29B. The fastening member 29 is positioned on the top of the umbrella canopy 1 and connects the umbrella canopy 1 with riveted connections. When the umbrella opens, a center portion of the umbrella canopy 1 relaxes, and the elastic force of the spring member 24 supports the center portion of the umbrella canopy 1 upward to form a pagoda shape. When the umbrella closes, the center portion of the umbrella canopy 1 moves downward along with the long umbrella ribs 31, the fastening member 29 moves downward with the center portion of the umbrella canopy 1, and the upper end of the spring member 29 moves downward with the fastening member.

The umbrella canopy 1 is sleeved with the fastening member 29 and the spring member 24 on the supporting pole 2, such that, when assembled, the spring member can tightly support the umbrella canopy.

According to the embodiment of the invention, as shown in FIGS. 1 and 3, the long umbrella ribs 31 and the short umbrella ribs 33 are formed of elastic cartilage materials, which can bend under wind pressure and can return to the original state automatically after the wind stops.

Figure 4:
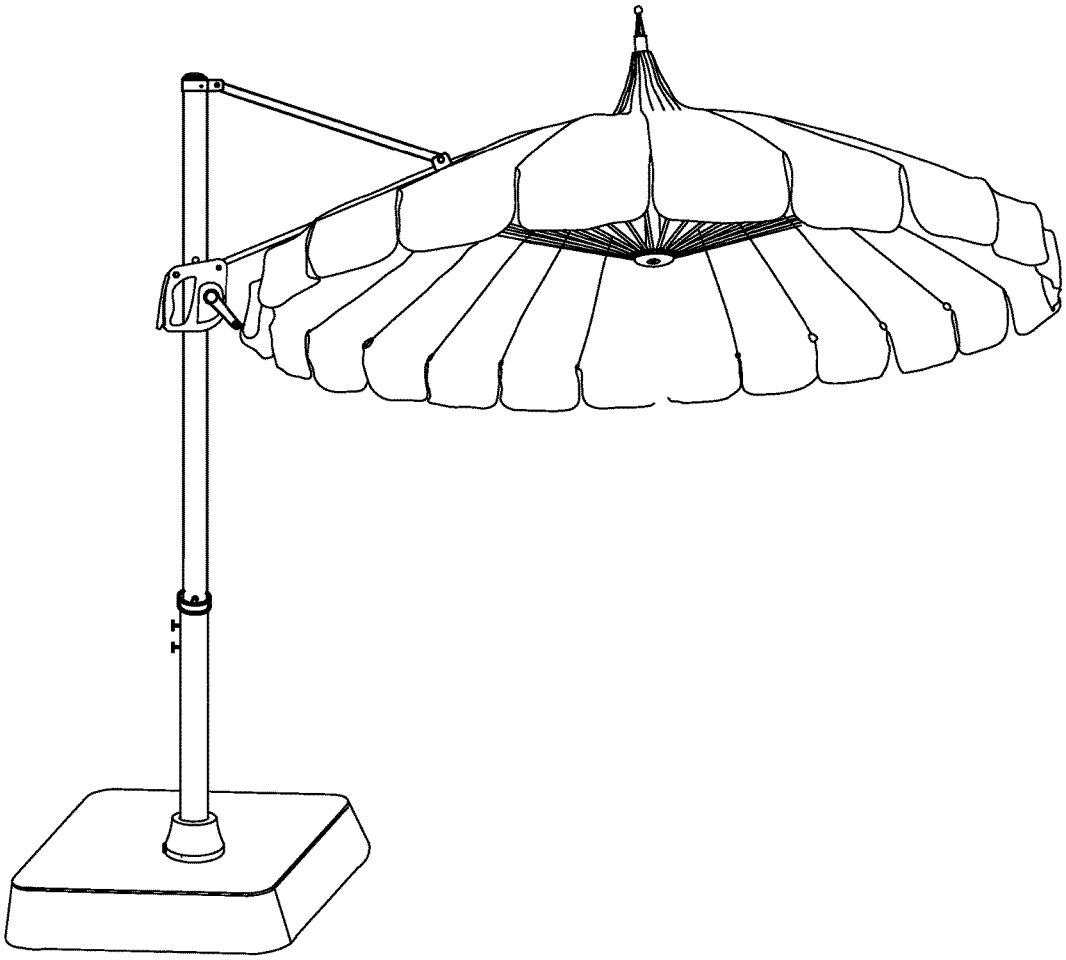
FIG. 4 shows a steeped sunshade offset/hanging umbrella according to one embodiment of the invention.

Referring to FIGS. 1 and 4, the umbrella structure according to one embodiment of the invention can be applied to kinds of pole umbrellas and offset umbrellas.

Figure 5:
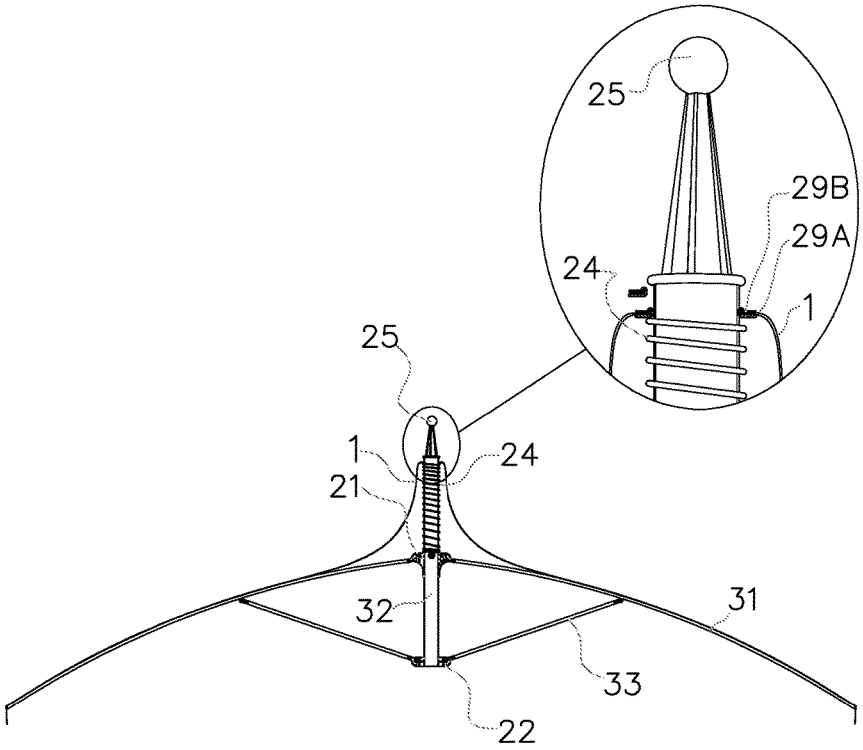
FIG. 5 shows a structural schematic of the umbrella stand body.

According to one embodiment of the invention, as shown in FIG. 5, the runner 22 is sheathed on the bottom of pole 32 to form the whole umbrella stand body 3. The other parts of the structure are the same as the embodiment described in FIG. 1.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A sunshade umbrella comprising:

a) an umbrella canopy;

b) an umbrella supporting pole having an upper end, a middle area and a lower end;

c) an umbrella stand body connected to the umbrella supporting pole, comprising:

an upper support element and a runner that extend upwardly and coaxially one above the other along the umbrella supporting pole within the umbrella stand body, the upper support element is positioned in the middle area of the umbrella supporting pole, the runner is sheathed on the umbrella supporting pole and can move up and down; and a plurality of long umbrella ribs each having a first end and a second end, a plurality of short umbrella ribs each having a first end and a second end, the first end of each of the long umbrella ribs is configured to rotatably connect to the upper support element, the first end of each of the short umbrella ribs is configured to rotatably connect to the runner, and the second end of each of the short umbrella ribs is hinged to a corresponding one of the long umbrella ribs;

d) a rope device connected to the umbrella supporting pole and opens and closes the umbrella; and e) a spring member positioned above the upper support element and supporting the umbrella canopy, and sleeved on the upper end of the umbrella supporting pole; and the umbrella canopy having a center portion movably connected to the upper end of the umbrella supporting pole and above the spring member, and the center portion of the umbrella canopy drives the spring upward and downward when the umbrella canopy is in an open position and a close position.

2. The sunshade umbrella of claim 1, wherein the plurality of long umbrella ribs and the plurality of short umbrella ribs are formed of elastic cartilage materials.

3. The sunshade umbrella of claim 1, wherein the plurality of long umbrella ribs and the plurality of short umbrella ribs are hard ribs shaped as long tubes.

4. The sunshade umbrella of claim 1, wherein the upper support element is arranged at the middle area of the umbrella supporting pole by a dower pin and a pulley member.

5. The sunshade umbrella of claim 1, further comprising a fastening member movably fixed to an upper end of the spring, and the center portion of the umbrella canopy is fixed to the fastening member, wherein:

when the sunshade umbrella opens, the spring member extends upward, and the fastening member and the center portion of the umbrella canopy moves upward with the upper end of the spring member, such that the center portion of the umbrella canopy forms a pagoda shape; and when the sunshade umbrella closes, the center portion of the umbrella canopy moves downward along with the long umbrella ribs, the fastening member moves downward with the center portion of the umbrella canopy, and the upper end of the spring member moves downward with the fastening member.

6. The sunshade umbrella of claim 1, wherein each of the long umbrella ribs has a curved shape, and when the sunshade umbrella opens, each of the long umbrella ribs curves downward.

* * * * *